US006415919B1

(12) United States Patent
Keller

(10) Patent No.: US 6,415,919 B1
(45) Date of Patent: Jul. 9, 2002

(54) GOLF BAG HAVING A LONGITUDINAL STAY AND A RETAINER CLIP THEREFOR

(75) Inventor: Gary E. Keller, Mesa, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/836,424

(22) Filed: Apr. 17, 2001

(51) Int. Cl.[7] ..... A63B 55/00

(52) U.S. Cl. ..... 206/315.8; 206/315.3; 206/315.7

(58) Field of Search ..... 206/315.3, 315.7, 206/315.8

(56) References Cited

U.S. PATENT DOCUMENTS 4,596,328 A 6/1986 Solheim
4,834,235 A 5/1989 Solheim et al.
D372,362 S 8/1996 Bryant et al.
5,769,220 A * 6/1998 Hong ..... 206/315.3
5,788,071 A * 8/1998 Shiao ..... 206/315.3
5,941,383 A * 8/1999 Cheng ..... 206/315.3

* cited by examiner

*Primary Examiner*—Jes F. Pascua
(74) *Attorney, Agent, or Firm*—Darrell F. Marquette

(57) ABSTRACT

A golf bag is provided with a throat structure disposed in an open top end of a generally tubular body with the throat structure having an opening formed therethrough that is divided into an open portion and an offset portion which is closed at its upper end. An elongated stay is located in a longitudinal position inside the tubular body, and the stay is inserted therein by moving it downwardly through the open portion of the throat structure opening. A retainer clip is removably mounted in the throat structure opening to retain an upper end of the stay in the offset portion of the opening. Removal of the stay may be accomplished by removing the retainer clip from the throat structure opening which allows movement of the stay upper end from the offset portion into the open portion so that the stay may be removed through the throat structure opening.

14 Claims, 3 Drawing Sheets

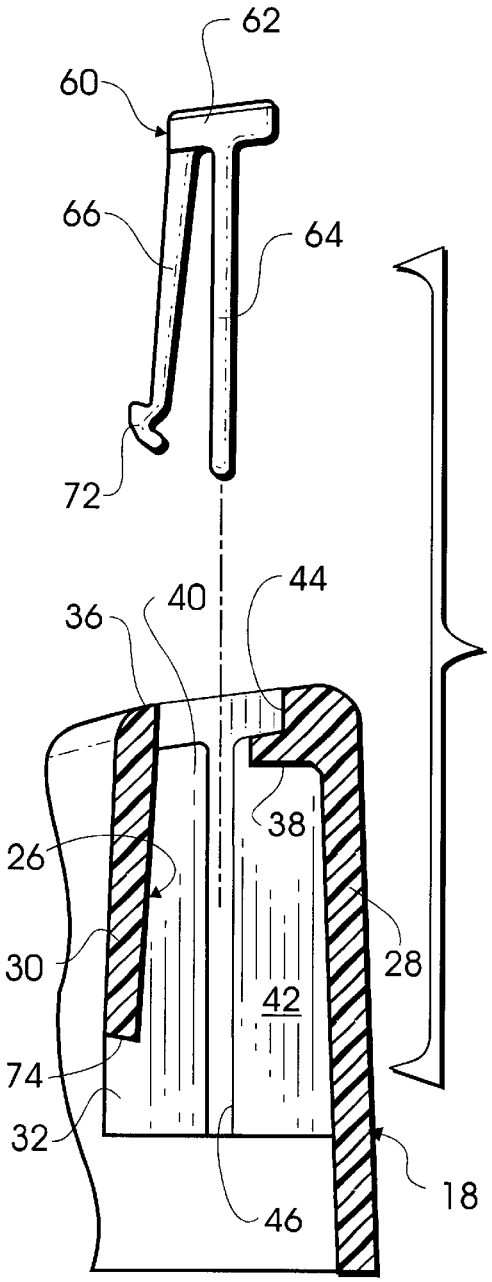
Fig.3
Fig.2
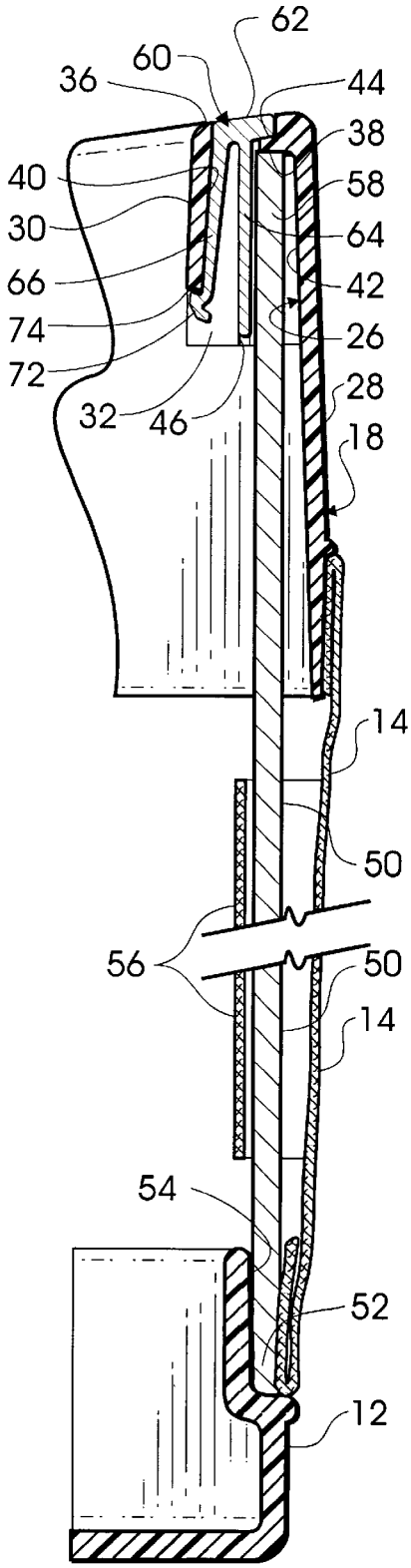

GOLF BAG HAVING A LONGITUDINAL STAY AND A RETAINER CLIP THEREFOR

BACKGROUND OF THE INVENTION

This invention relates generally to golf bags and, in particular, to a golf bag having a longitudinal stay and a retainer clip therefor.

Many golf bags have tubular bodies held in their desired shape by a liner formed of a suitable plastic which is enclosed within a fabric outer wall. Other golf bags referred to as "carry bags", due to their light weight, are often formed with tubular fabric bodies that are held in their desired shape by at least one stay or strut which extends longitudinally from the open top end of the body to the closed bottom end thereof. In some carry bags, there are several stays circumferentially spaced about the tubular body with their opposite ends attached to the open top end and the closed bottom end of the body. In both of these prior types of golf bags, i.e. the golf bags with the plastic liners and the golf bags with the stays, there are drawbacks when shipping the golf bags from a manufacturing facility to a retail outlet and when repairing damaged golf bags. Both the plastic liners and the stays are fixed in place when the golf bags are manufactured and, therefore, the golf bags cannot be collapsed or otherwise reduced in size for shipping. If the stays of a golf bag become bent or broken, repair is difficult and often the golf bag must be disassembled to accomplish the needed repair.

The drawbacks of the above-described prior types of golf bags are overcome in golf bags with removable stays. These golf bags may be shipped in a collapsed condition and then the removable stays may be inserted upon arrival of the golf bags at their destination. Also, repair of bent or broken stays is easier because the bent or broken stays may be removed without disassembling the golf bags. However, removable stays are difficult to install and remove without damaging them or the golf bags.

The difficulty with installing and removing the removable stays results from the manner in which they are held in position within a golf bag and their placement therein. A suitable pocket is formed adjacent the closed bottom end of the golf bag body. The lower end of the stay is disposed within the pocket while the upper end of the stay is held in a blind socket formed in the open top end of the golf bag body. In addition, the removable stay usually extends through a fabric sleeve inside the golf bag body. Since the distance between the pocket and the blind socket is equal to the length of the stay, the stay must be bent for installation and removal. However, such bending of the stay is difficult because the stay extends through the sleeve.

SUMMARY OF THE INVENTION

A golf bag includes a generally tubular body having an open top end a closed bottom end. A throat structure is disposed in the open top end of the body. The throat structure has an opening formed longitudinally therethrough which is divided into an open portion and an offset portion which is closed at its upper end and laterally disposed relative to the open portion. An elongated stay extends into the throat structure and is located in a longitudinal position inside the tubular body. The stay has an upper end movable in the throat structure opening between the open portion and the offset portion thereof A retainer clip is removably mounted in the throat structure opening for retaining the upper end of the stay in the offset portion thereof. When the retainer clip is removed from the throat structure opening, the upper end of the stay is allowed to be moved between the open portion and the offset portion thereof.

In the preferred embodiment of the golf bag, the throat structure has an outer wall, an inner wall and a pair of side walls which together define the throat structure opening. The throat structure also has a ledge extending from the outer wall into the throat structure opening to divide the opening into the open portion and the offset portion and to close the upper end of the offset portion. The ledge is located below a top surface of the throat structure to provide a recessed seat at a top end of the throat structure opening. The retainer clip includes a pedestal shaped to fit within the recessed seat at the top end of the throat structure opening, a fixed leg depending from the pedestal for retaining the upper end of the stay in the offset portion of the throat structure opening, and a spring leg depending from the pedestal in spaced relationship with respect to the fixed leg. This spring leg is deflected toward the fixed leg by the inner wall which partially defines the throat structure opening.

DESCRIPTION OF THE DRAWINGS

FIG. 2 is an enlarged fragmentary sectional view taken along the line 2—2 in FIG. 1;

FIG. 3 is an enlarged fragmentary sectional view showing portions of the golf bag and the retainer clip removed therefrom;

DESCRIPTION OF THE PREFERRED EMBODIMENT

Figure 1:
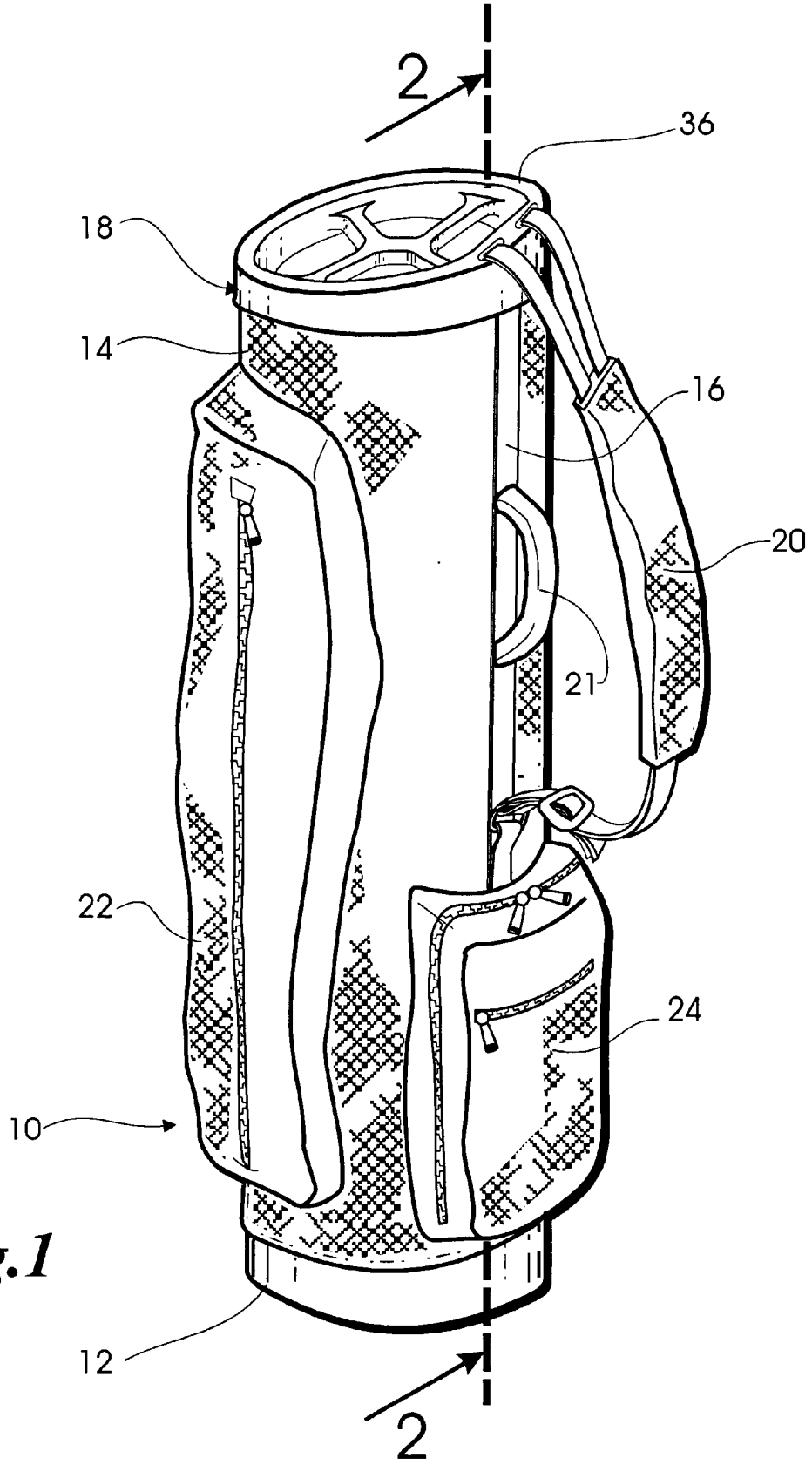
FIG. 1 is a perspective view of a golf bag incorporating a longitudinal stay and a retainer clip of the present invention.

Referring to the drawings, FIG. 1 shows a golf bag which includes the present invention and is indicated generally by the reference numeral 10. The golf bag 10 includes a bottom assembly 12, such as disclosed in U.S. Pat. No. D372,362 to L. J. Bryant et al, which is typically a cup-shaped structure formed of a suitable synthetic resin, and a generally tubular body 14 preferably formed of a suitable fabric. The bottom assembly 12 provides the tubular body 14 with a closed bottom end. The tubular body 14 has a longitudinal spine 16 at one side thereof and an open top end into which a throat structure 18, such as disclosed in U.S. Pat. No. 4,596,328 to J. A. Solheim, is disposed. The spine 16 extends between the open top end and the closed bottom end of the body 14. The golf bag 10 also includes a shoulder strap 20, a handle 21, and storage pockets 22 and 24.

Figure 4:
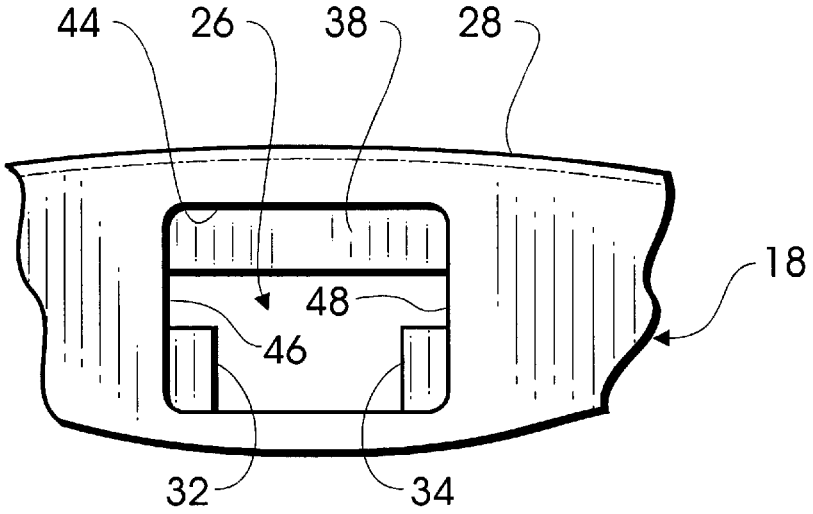
FIG. 4 is a plan view of a portion of the golf bag.

As seen best in FIGS. 3 and 4, the throat structure 18 has an opening 26 defined by an outer wall 28, an inner wall 30 and a spaced apart pair of side walls 32 and 34. The opening 26 extends longitudinally through the throat structure 18 so as to extend upwardly through a top surface 36 thereof and downwardly into the tubular body 14. A ledge 38 extends from the outer wall 28 into the opening 26 to divide the opening 26 into an open portion 40 and a laterally disposed offset portion 42 which lies below the ledge 38. The ledge 38 closes the upper end of the offset portion 42 of the opening 26 and is located a short distance below the top surface 36 of the throat structure 18 to provide a recessed seat 44 at the top end of the opening 26. As seen best in FIG. 4, the throat structure 18 is also provided with a pair of grooves 46 and 48 each formed in a different one of the opposed pair of side walls 32 and 34 with these grooves 46, 48 being disposed to face inwardly into the opening 26. The grooves 46 and 48 extend downwardly from the recessed seat 44 to the bottom end of the opening 26.

As seen in FIG. 2, an elongated stay or strut 50 is located in a longitudinal position inside the body 14 substantially parallel to the spine 16 with a lower end 52 of the stay 50 received in a pocket 54 which is formed between the bottom assembly 12 and the tubular body 14. An upper end 58 of the stay 50 extends into the opening 26 in the throat structure 18. Alternatively, the pocket 54 could be of any.suitable configuration such as a socket (not shown) molded in the bottom assembly 12. U.S. Pat. No. 4,834,235 to J. A. Solheim et al discloses a golf bag with a rigidfying strut that is similar to the stay 50. The stay 50 is preferably of generally rectangular cross-section and is preferably formed of fiberglass. It will be appreciated that other materials such as graphite may be used to make the stay 50 so long as the selected material is relatively flexible and is strong enough to withstand the normal wear and tear to which golf bags are subjected.

The stay 50 extends upwardly from the pocket 54 and passes through a fabric sleeve 56 which is sewn inside the tubular body 14. The upper end 58 of the stay 50 is disposed within the laterally offset portion 42 of the opening 26 in abutting engagement with the ledge 38 which prevents longitudinal movement of the stay 50. Lateral movement of the stay upper end 58 from the offset portion 42 into the open portion 40 of the opening 26 is prevented when a retainer clip 60 is removably mounted in the opening 26.

Figure 5:
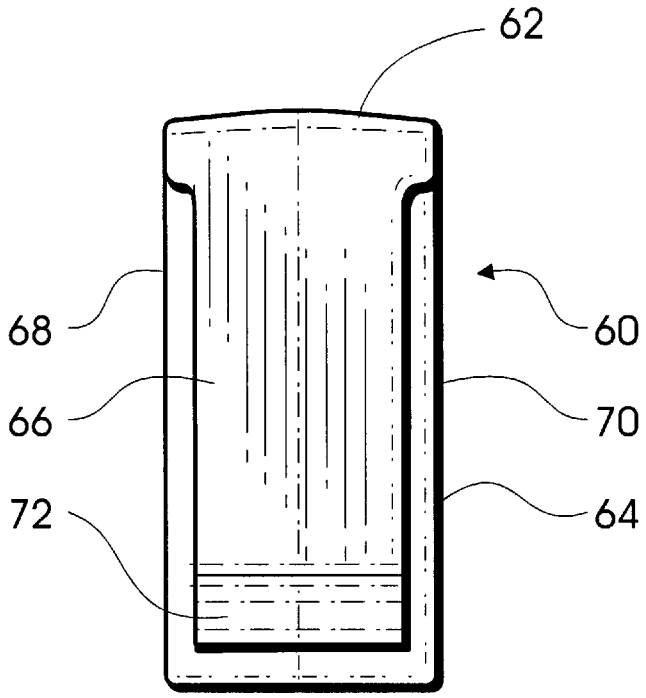
FIG. 5 is a front elevational view of the retainer clip shown in FIG. 3.

The retainer clip 60, as seen best in FIGS. 3 and 5, includes an upper pedestal 62 of generally rectangular configuration which is shaped to fit in the recessed seat 44 with the pedestal 62 in seated engagement with the ledge 38 when the retainer clip 60 is positioned within the opening 26. A fixed leg 64 and a spring leg 66 depend in spaced apart relationship from the pedestal 62. The fixed leg 64 has opposite side edges 68 and 70 slidably disposed within the grooves 46 and 48 formed in the throat structure 18. The spring leg 66 of the retainer clip 60 has a narrower width dimension than the fixed leg 64 so that it will be disposed in a space between the side walls 32 and 34 in which the grooves 46 and 48 are formed and will be free to move in that space. The spring leg 66 of the retainer clip 60 will be in a relaxed state so that it will depend from the pedestal 62 at a diverging angle with respect to the fixed leg 64 when the retainer clip 60 is removed from the opening 26 as shown in FIG. 3. The spring leg 66 is moved to an inwardly deflected position by a cam member 72 formed at the depending end of the spring leg 66 which moves into bearing engagement with the inner wall 30 of the throat structure 18 when the retainer clip 60 is pushed downwardly into the opening 26. When the retainer clip 60 reaches a fully inserted position as shown in FIG. 2, the cam member 72 is engaged in a notch or slot 74 formed at the lower end of the inner wall 30 as a result of the spring action of the leg 66. When the cam member 72 moves into the slot 74, it will latch the retainer clip 60 in a latched position within the opening 26 of the throat structure 18.

The opening 26 in the throat structure 18, the sleeve 56 and the pocket 54 are in longitudinal alignment with each other and are preferably disposed proximate the spine 16 of the body 14. Therefore, with.the retainer clip 60 removed from the opening 26, insertion of the stay 50 is accomplished by sliding it downwardly through the open portion 40 of the opening 26 and through the sleeve 56 so that the lower end 52 of the stay 50 enters the pocket 54. The upper end 58 of the stay 50 is moved manually from the open portion 40 of the opening 26 into the offset portion 42 thereof prior to insertion of the retainer clip 60. Subsequent insertion of the retainer clip 60 into the opening 26, as described above, will position the fixed leg 64 in engagement with the upper end 58 of the stay 50 and retain the upper end 58 of the stay 50 in the offset portion 42 of the opening 26.

Should it be necessary or desirable to remove the stay 50, the cam member 72, which protrudes through the slot 74 when the retainer clip 60 is in the latched position, may be pushed toward the outer wall 28 of the opening 26 by hand or by using a suitable tool (not shown) such as a golf tee. This will unlatch the retainer clip 60 for removal from the opening 26. The upper end 58 of the stay 50 may then be moved manually from the offset portion 42 into the open portion 40 of the opening 26 and is thus released for upward movement to remove it.

What is claimed is:

1. A golf bag comprising:

a generally tubular body having an open top end and a closed bottom end;

a throat structure disposed in the open top end of said body, said throat structure having an opening formed longitudinally therethrough which is divided into an open portion and an offset portion which is closed at its upper end and laterally disposed relative to the open portion;

an elongated stay extending into said throat structure opening and being located in a longitudinal position inside the tubular body, said stay having an upper end movable in said throat structure opening between the open portion and the offset portion thereof; and a retainer clip removably mounted in said throat structure opening for retaining the upper end of said stay in the offset portion thereof but allowing the upper end of said stay to be moved between the open portion and the offset portion when said retainer clip is removed from said throat structure opening.

2. The golf bag of claim 1, further comprising a sleeve inside the tubular body through which said stay extends.

3. The golf bag of claim 1, further comprising a pocket formed proximate the closed bottom end of said body, and wherein said stay has a lower end received in said pocket.

4. The golf bag of claim 1, wherein said tubular body has a spine extending between the open top end and the closed bottom end thereof, and wherein said stay is arranged substantially parallel to said spine.

5. The golf bag of 1, further comprising:

the tubular body having a spine at one side thereof extending between the open top end and the closed bottom end thereof;

a sleeve inside the tubular body;

a pocket proximate the closed bottom end of said body; and said sleeve, said pocket and said throat structure opening being aligned so that said stay is disposed in said sleeve, said pocket and said throat structure opening and is arranged substantially parallel to said spine.

6. The golf bag of claim 1, wherein said throat structure has an outer wall, an inner wall and a pair of side walls which together define said throat structure opening.

7. The golf bag of claim 6, wherein said throat structure has a ledge extending from the outer wall into said throat structure opening to divide the opening into the open portion and the offset portion thereof and to close the upper end of the offset portion.

8. The golf bag of claim 7, wherein the ledge is located below a top surface of said throat structure to provide a recessed seat at a top end of said throat structure opening.

9. The golf bag of claim 8, wherein said retainer clip comprises:

a pedestal shaped to fit within the recessed seat at the top end of said throat structure opening;

a fixed leg depending from said pedestal for retaining the upper end of said stay in the offset portion of said throat structure opening; and a spring leg depending from said pedestal in spaced relationship with respect to said fixed leg, said spring leg being deflected toward said fixed leg by the inner wall which partially defines said throat structure opening.

10. The golf bag of claim 6, further comprising:

said throat structure having a ledge extending from the outer wall thereof into said throat structure opening to divide the opening into the open portion and the offset portion and to close the upper end of the offset portion, said ledge being located below a top surface of said throat structure to provide a recessed seat at a top end of said throat structure opening;

the spaced apart side walls which partially define said throat structure opening each having a groove formed therein to provide a pair of grooves which face inwardly into the opening and extend downwardly from said recessed seat through the opening; and the inner wall which partially defines said throat structure opening having a notch formed at a lower end thereof.

11. The golf bag of claim 10, wherein said retainer clip comprises:

a pedestal shaped to fit within the recessed seat formed at the upper end of said throat structure opening;

a fixed leg depending from said pedestal and having opposed side edges each of which is slidably positioned within a different one of the pair of grooves provided in the side walls; and a spring leg depending from said pedestal in spaced relationship with respect to said fixed leg, said spring leg being deflected toward said fixed leg by the inner wall which defines said throat structure opening.

12. The golf bag of claim 11, wherein the spring leg of said retainer clip has a cam member located at its lower end for engagement in the notch provided at the lower end of the inner wall to latch said retainer clip in a latched position in said throat structure opening.

13. The golf bag of claim 12, wherein said cam member protrudes from the notch provided at the lower end of the inner wall when the retainer clip is in said latched position to permit said cam member to be pushed out of engagement with the notch to unlatch said retainer clip for removal from said throat structure opening.

14. The golf bag of claim 1, wherein said retainer clip comprises a fixed leg for retaining the upper end of the stay in the offset portion of said throat structure opening, and wherein said retainer clip also comprises a spring leg which is deflected toward said fixed leg when said retainer clip is inserted in said throat structure opening.

* * * * *